United States Patent [19]

Bates et al.

[11] 4,072,082

[45] Feb. 7, 1978

[54] RECOIL CONVERTER

[75] Inventors: P. A. Bates, Essex Junction; L. R. Folsom, Williston; A. J. Haberstroh, North Hero, all of Vt.

[73] Assignee: General Electric Company, Burlington, Vt.

[21] Appl. No.: 520,858

[22] Filed: Nov. 4, 1974

[51] Int. Cl.[2] ..... F41D 5/02

[52] U.S. Cl. ..... 89/162; 89/44 R; 89/172

[58] Field of Search ..... 89/4 R, 4 A, 4 B, 33 BC, 89/33 CA, 162, 44 R, 172; 42/5

[56] References Cited

U.S. PATENT DOCUMENTS 3,866,513 2/1975 Hornfeck et al. ..... 89/4 B

*Primary Examiner*—Stephen C. Bentley

*Attorney, Agent, or Firm*—Bailin L. Kuch

[57] ABSTRACT

A gun is provided having an operating mechanism and an energy storage system which receives and stores energy from the gun housing during the recoil of the gun and which subsequently transfers said stored energy to said operating mechanism during each gun cycle.

11 Claims, 13 Drawing Figures

52
56
48
50
40
42
60
62
54
58
80
90
88
82
68
78RH
66RH
64L
74
86

RECOIL CONVERTER

BACKGROUND OF THE INVENTION

1. Field of the Invention

This invention relates to mechanisms for absorbing the recoil force of guns.

2. Prior Art

Conventionally most of the recoil force of a gun which is mounted on a pair of trunnions is absorbed by a pair of recoil adapters through respective displacements and converted into heat. Each adapter may contain a mechanical or fluid spring mechanism. A portion of the recoil force may be utilized to directly drive an ammunition feed mechanism, as shown for example, by A. L. Montana in U.S. Pat. No. 3,596,556 issued Aug. 3, 1971, and by B. Maillard et al in U.S. Pat. No. 3,417,657 issued Dec. 24, 1968.

In U.S. Pat. No. 3,915,058 issued on Oct. 28, 1975 to L.R. Folsom et al there is disclosed a gun which minimizes peak recoil forces on the trunnions by transferring much of the recoil force during the recoil period of the gun cycle to a rotary gun drive mechanism.

SUMMARY OF THE INVENTION

It is an object of this invention to provide a recoil converter, particularly adapted for use in the gun of U.S. Pat. No. 3,915,058 which absorbs and stores recoil force during the recoil period of the gun cycle and which transfers the stored force during the counter-recoil period to the gun drive mechanism.

A feature of this invention is the provision of a gun having an operating mechanism and an energy storage system which receives and stores energy from the gun housing during the recoil of the gun and which subsequently transfers said stored energy to said operating mechanism, during each gun cycle.

BRIEF DESCRIPTION OF THE DRAWING

These and other objects, features and advantages of the drawing will be apparent from the following specification thereof taken on conjunction with the accompanying drawing in which:

FIG. 3 is a detail side elevation view in cross-section of the first embodiment of a portion of the recoil energy storage and return mechanism, taken along the plane 3—3 of FIG. 4;

DESCRIPTION OF THE FIRST EMBODIMENT

Figure 1:
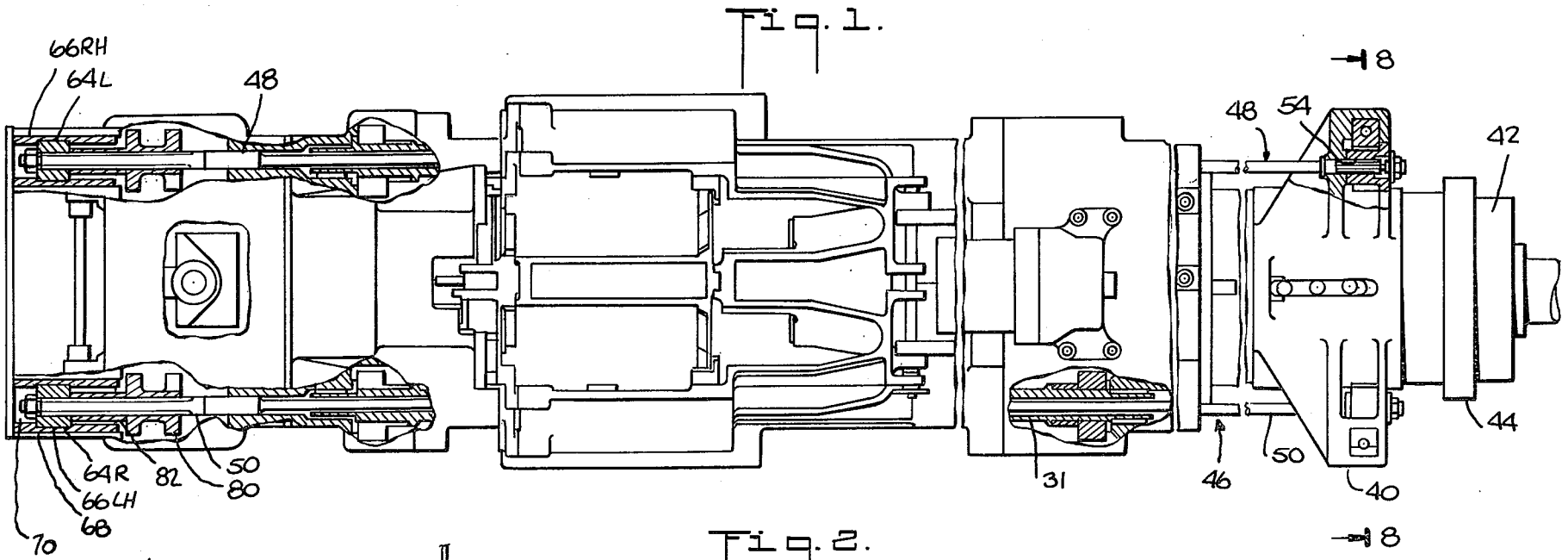
FIG. 1 is a top plan view of a gun including a first embodiment of the invention.
Figure 2:
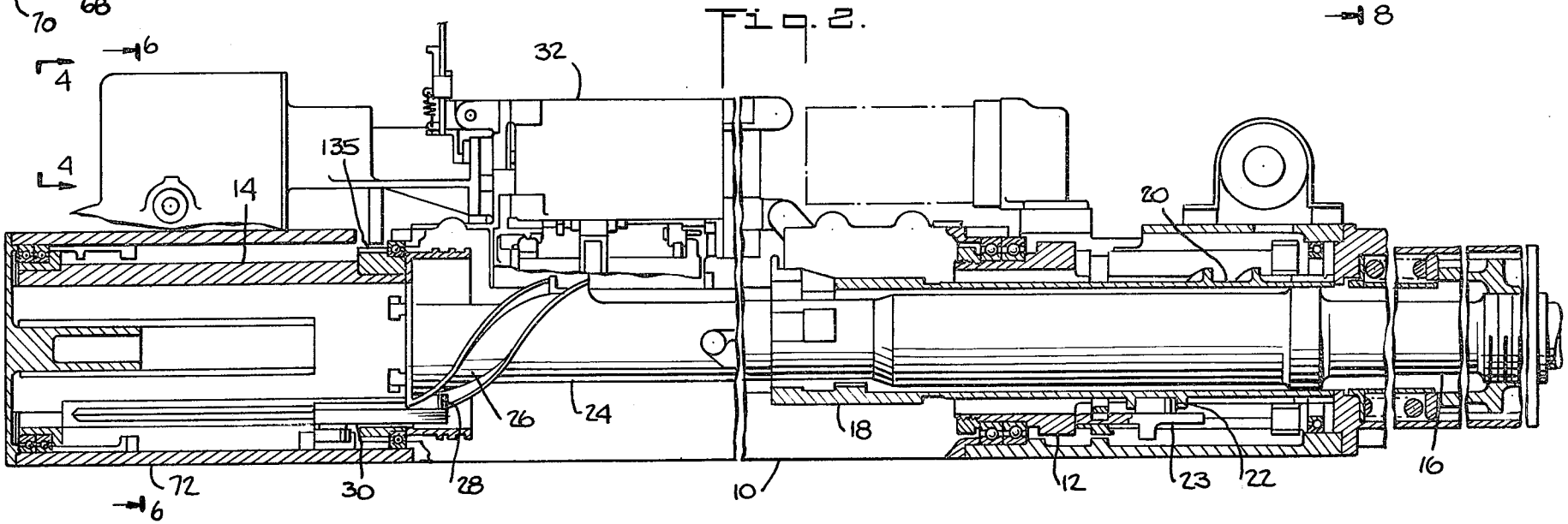
FIG. 2 is a side elevation view of the gun of FIG. 1.
Figure 9:
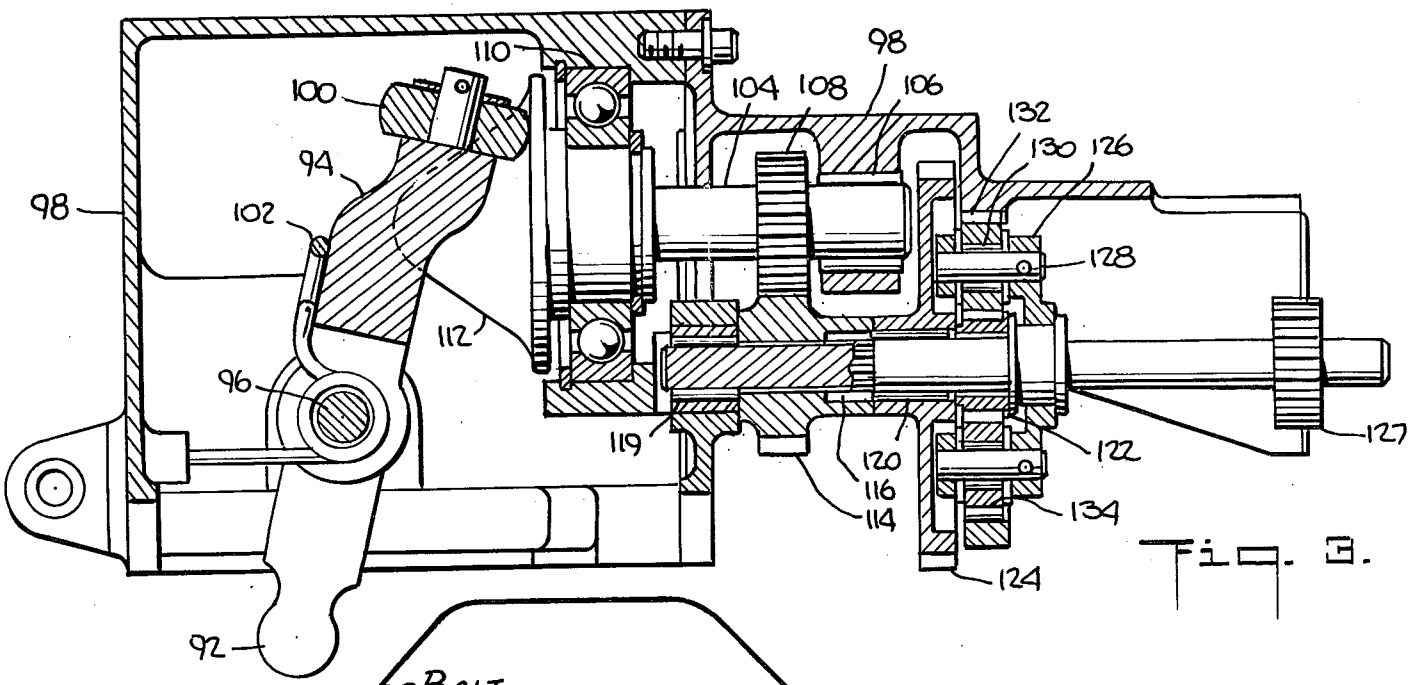
FIG. 9 is plan view in cross-section of the forward mounting of the torsion shafts of FIG. 8.

The basic gun and its operating mechanism are disclosed in U.S. Pat. No. 3,915,058 supra; and a dual feeder mechanism for the gun is disclosed in Ser. No. 498,353, filed Aug. 19, 1974 by L. R. Folsom et al, to which reference may be made for structure not herein disclosed. Briefly recapitulating, that gun includes a housing 10 in which are journaled for rotation a forward rotor 12 and an aft rotor 14. A gun barrel 16 and barrel extension 18 are journaled for reciprocation in the housing and the extension has a cam track 20 in which rides a cam follower 22 mounted to a slide 23 channeled to the forward rotor 12. A gun bolt 24 is journaled for reciprocation in the housing and has a cam track 26 which receives a cam driver 28 mounted on a slide 30 which is driven by the aft rotor 14. Recoil of the gun barrel rotates the forward rotor 12, which by a pair of intermediate tubular shafts 31 and spur gears is coupled to and rotates the aft rotor 14, which reciprocates the gun bolt 24, the forward rotor, the aft rotor and the bolt being on concentric axes. The dual feeder 32 includes an outer pair of right side and left side stripper sprocket assemblies and an inner pair of right side and left side feeder assemblies, of which only one side or the other at any time is effective, to side strip rounds from their links and to laterally hand them off to the face of the gun bolt.

The mechanisms hereinafter described served to supplement the forward and aft rotors by extracting and storing energy from the recoil of the gun housing during the beginning of the gun cycle and subsequently transferring this stored energy to the operating mechanism and the bolt later in the period of the gun cycle. Thus, energy for bolt reciprocation is provided by the barrel for the first 180° of gun cycle and by the mechanisms for the last 180° of cycle, as shown in FIG. 10.

A gun mount 40 is journaled to and supports to the forward gun tube 42 which is part of the gun housing. The tube 42 can reciprocate in the mount 40. The mount is fixed to the stationary gun support trunnions by an integral collar 44. A right side and a left side torsion shaft assembly 46 and 48 couple the gun mount 40 to the gun housing 10. Each torsion shaft assembly includes a torsion shaft 50 which is disposed within the rotor shaft 31 and is splined at both ends. An internally splined spur gear 52 is fixed onto the splined forward end of the shaft 50 and is disposed in a stepped, longitudinal bore 54 in the gun mount 40. A spur gear rack 56 is journaled for reciprocation in a transverse bore 58 in the gun mount and is positioned longitudinally by a bolt 60 bearing on a washer 62 and threaded into a longitudinal bore in the rack. Rotation of the bolt via the rack and the gear thus rotates the torsion shaft with respect to the gun mount and is used to prestress the shaft. An internally splined cylinder 64 is fixed onto the splined aft end of the shaft 50. The right side cylinder 64R has a left hand helical track 66LH. The left side cylinder 64L has a right hand helical track 66RH. The cylinder 64 is disposed in a sleeve 68, which sleeve is disposed in a bore 70 in the aft housing 72 and has a transversely extending ear 74 which is bolted at 76 to the housing. The right side sleeve 68R has a left hand helical rib 78LH which mates with the track 66LH. The left side sleeve 68L has a right hand helical rib 78RH which mates with the track 66RH. Longitudinal motion of the housing 72 via the mating helical tracks and ribs thus causes rotation of the aft ends of the torsion shafts 50. Thus recoil of the housing including the forward gun tube 42 with respect to the stationary gun mount 40 will torsionallly stress the two torsion shafts, absorbing and storing energy therein. An internally splined clevis 80 is fixed onto the aft portion of the shaft 50 forward of cylinder 64 by a spacer sleeve 82. The cylinder, sleeve and clevis are captured on the shaft between a forward shaft shoulder 84 and an aft nut 86. The clevis 80 has a laterally extending shoulder 88 which, when the clevis is rotated by the shaft to its maximum excursion, abuts the inner wall of the housing. Each clevis has an annular groove 90 to receive a respective rounded foot 92 of a two-footed, single headed yoke 94. The yoke is pivoted on a transverse shaft 96 which is journaled in a housing 98, and has a single upper arm on which is journaled a cam driver roller 100. A helical spring 102 is mounted on the shaft 96 and biases the upper arm of the yoke forwardly and the feet aftwardly. When the housing recoils aft, it carries the shaft 96 aft, which swings the feet 92 of the yoke forwardly, while still remaining in the annular groove 90 of the clevis 80. After the housing has completed its recoil travel, storing energy in winding up the torsion shafts, the torsion shafts unwind moving the housing 98 and the transverse shaft 96 forwardly and thus the feet 92 aftwardly.

A shaft 104 is journaled longitudinally in the housing 98. The shaft has a forward needle bearing 106, an annular spur gear 108, an aft ball bearing 110, and an aft concave face cam 112. The gear 108 is meshed with a spur gear 114 which is splined to a shaft 116 which is also journaled longitudinally in the housing 98. The shaft has an aft needle bearing 119, an intermediate needle bearing 120 on which is journaled a two level gear having a forward small ring gear 122 and a large aft ring gear 124, a spider 126, and a forward spur gear 127. The spider carries two shafts 128 each respectively carrying a needle bearing 130 and a planetary gear 132. Each of the planetary gears is meshed with the gear 122 and an annular gear 134 formed on the interior wall of the housing 98. The ring gear 124 is meshed with a ring gear 135 formed on the aft rotor 14. Thus, as the yoke cam roller 100 is driven forward by the unwiding torsion shafts it engages the face cam 112 and rotates it, thereby rotating the shaft 104 and the aft rotor 14.

Figure 10:
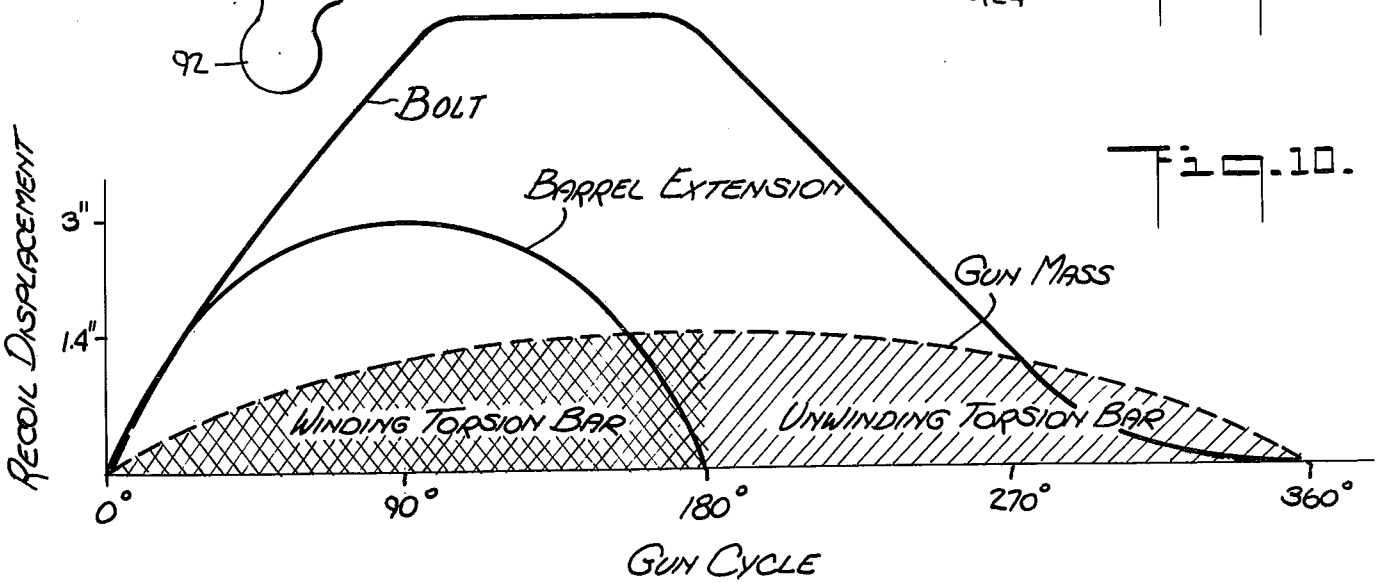
FIG. 10 is chart of the operating cycle of the gun of FIG. 1.
Figure 4:
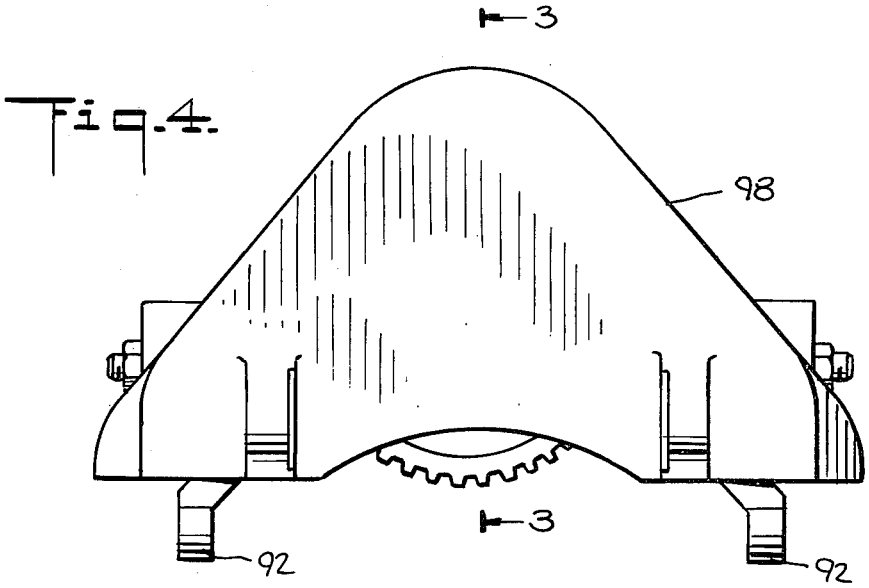
FIG. 4 is an aft view of the device shown in FIG. 3, taken along the plane 4–4 of FIG. 2.
Figure 6:
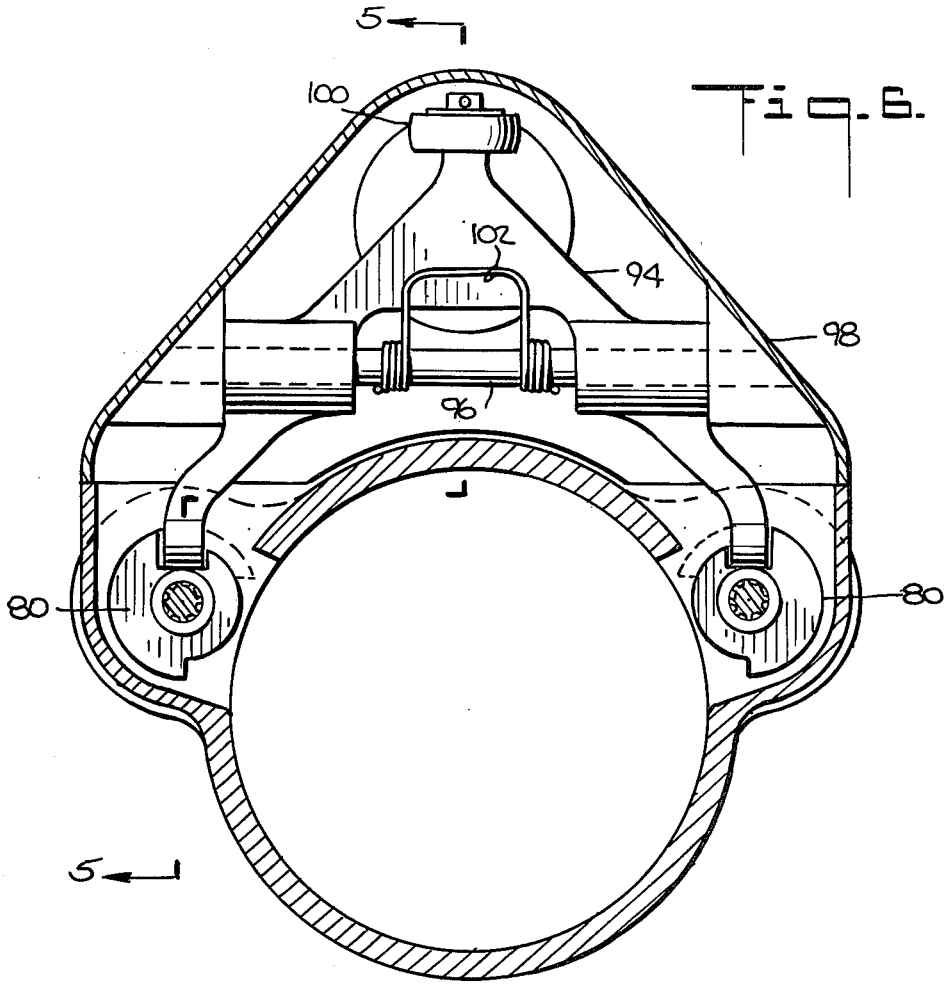
FIG. 6 is a detail aft view in cross-section of the device shown in FIG. 3, taken along the plane 6—6 of FIG. 2.
Figure 5:
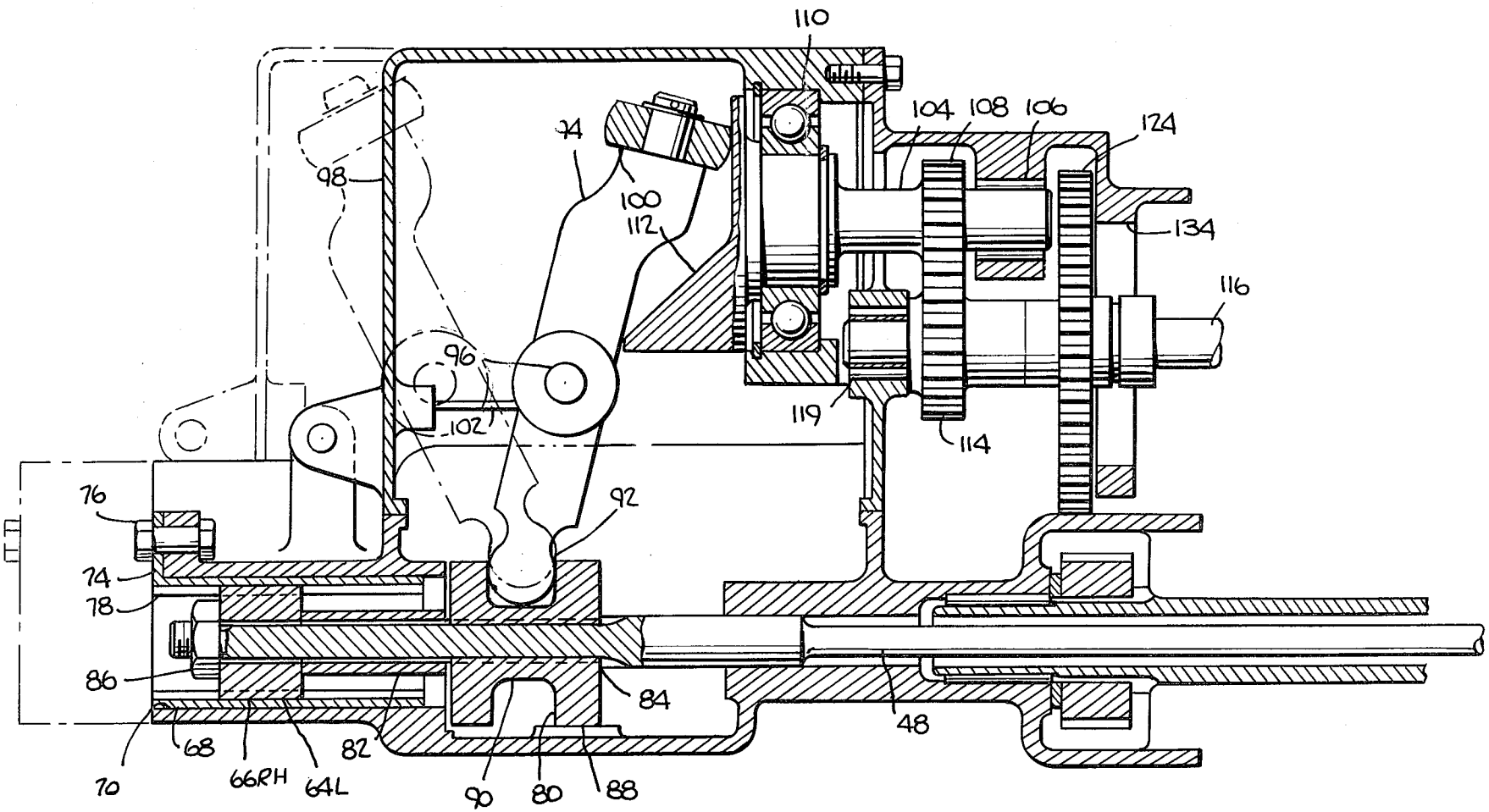
FIG. 5 is a detail side elevation view in cross-section of the device shown in FIG. 3, taken along the plane 5—5 of FIG. 6.
Figures 7, 8, 9:
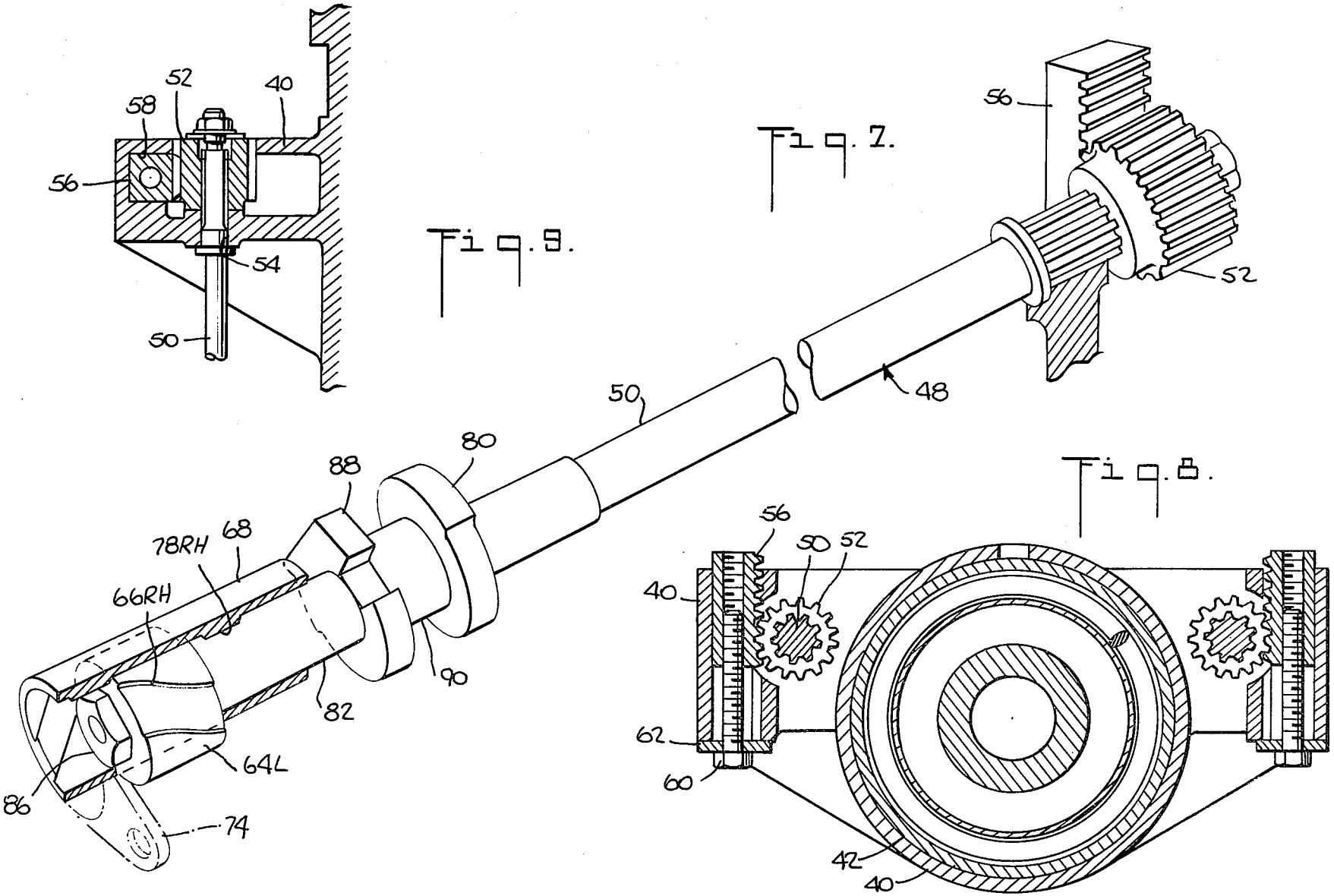
FIG. 7 is a perspective view of the torsion shaft assembly.
FIG. 8 is a detail aft view in cross-section of the forward mounting of the torsion shafts of this invention, taken along the plane 8—8 of FIG. 1.

It will be seen from FIG. 10 that the gun housing recoils from 0° to 180° and counterrecoils from 180° to 360° of the gun and rotor cycles, while the barrel extension recoils from 0° to 90° and counterrecoils from 90° to 180° of the gun and rotor cycles. The torsion bars wind up and absorb energy from 0° to 180°, and unwind and transfer energy from 180° to 360° of the gun and rotor cycles.

The spur gear 127 is meshed with the stripping sprocket assembly drive mechanisms and the aft rotor gear 135 is meshed with the feeder arm assembly drive mechanisms disclosed in Ser. No. 498,353. Thus the torsion shafts also supply energy previously extracted from the recoil momentum of the housing to these mechanisms from 180° to 360° of the gun and rotor cycles.

DESCRIPTION OF THE SECOND EMBODIMENT

Figure 11:
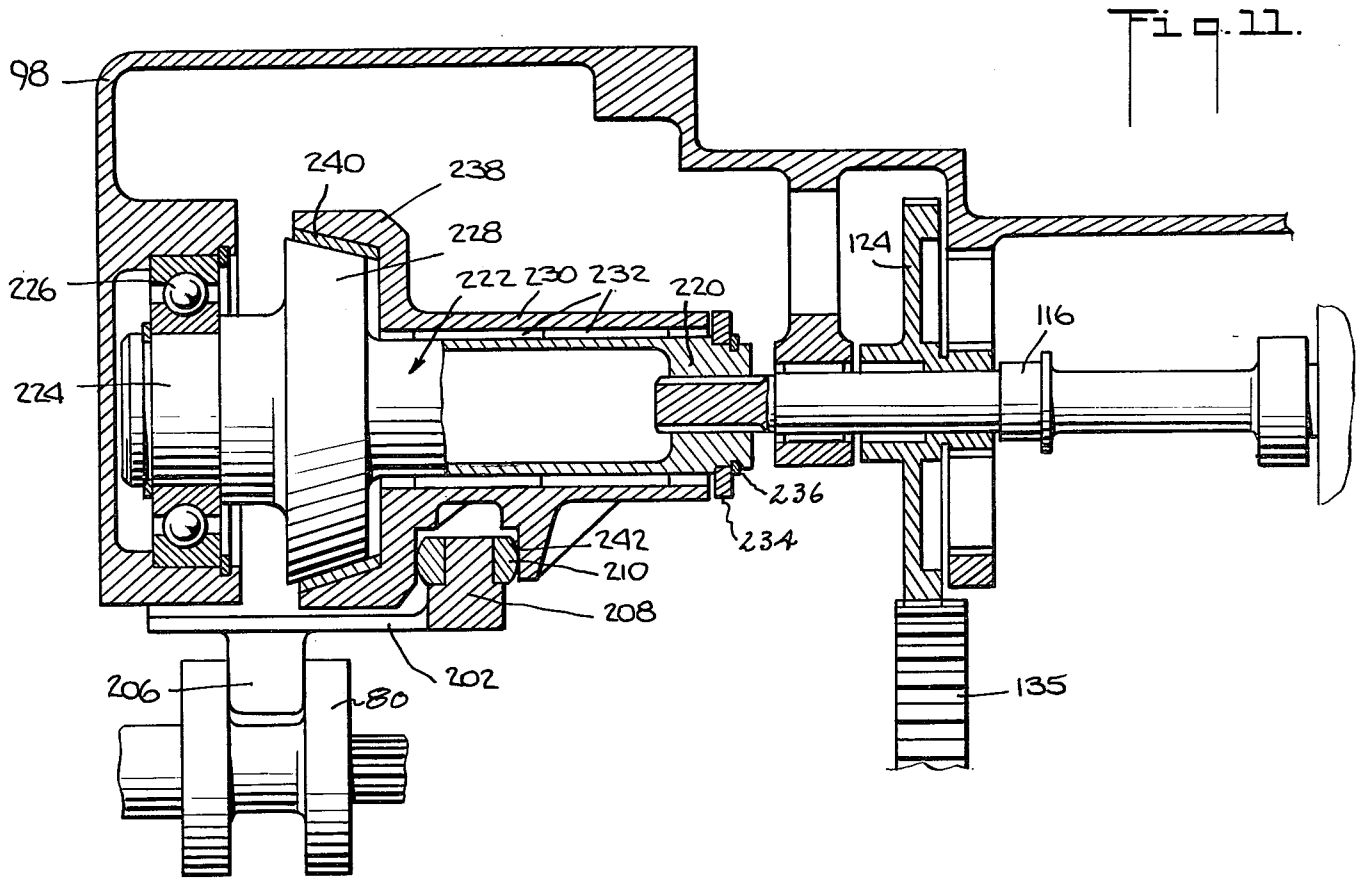
FIG. 11 is a detail side elevation view in cross-section of a second embodiment of the device shown in FIG. 3.
Figure 12:
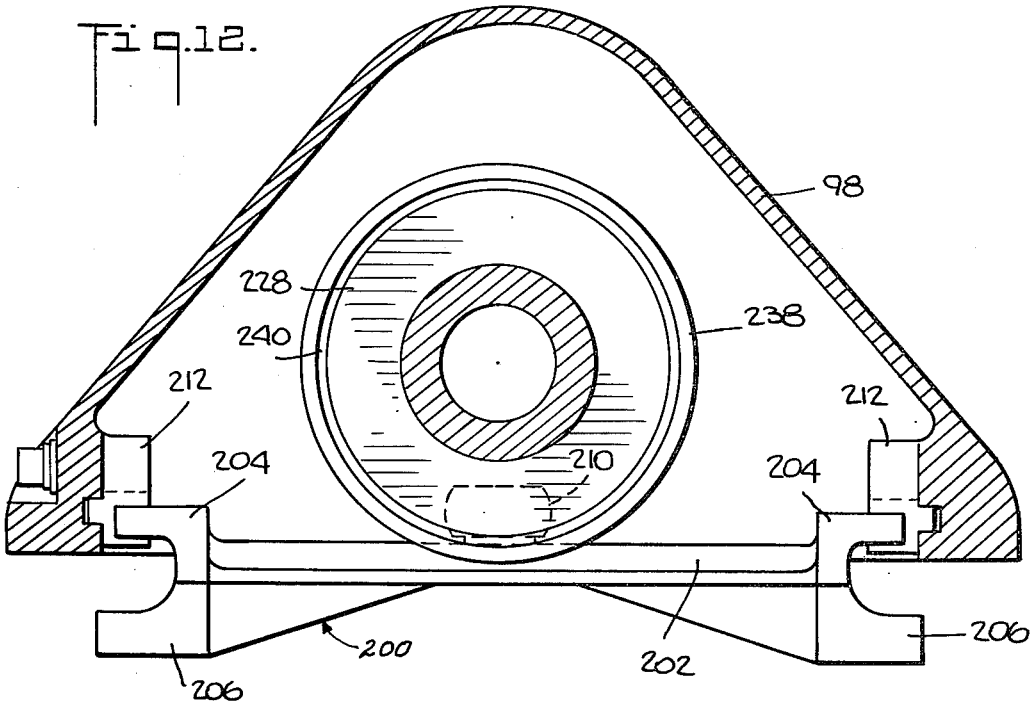
FIG. 12 is a detail aft view in cross-section of the device shown in FIG. 11.
Figure 13:
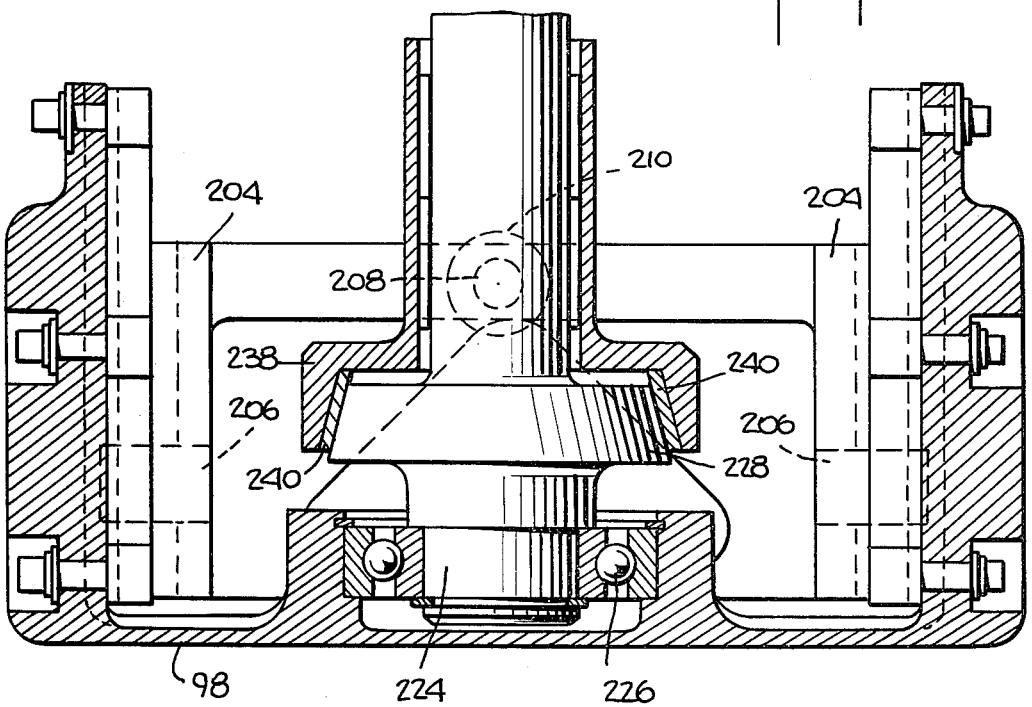
FIG. 13 is a plan view in cross-section of the device shown in FIG. 11.

An alternative mechanism for transmitting the energy stored in the torsion shafts 50 is shown in FIGS. 11 through 13. A slide 200 has a corss-web 202, having a pair of transversely spaced apart, longitudinally extending rails 204, a pair of transversely spaced apart feet 206, each foot 206 adapted to ride in the annular groove 90 of a respective clevis 80, and an upstanding stud 208 on which is journaled a cam driver roller 210. The rails 204 ride fore and aft in a pair of transversely spaced apart respective channels 212 which are fixed to the interior side walls of the housing 98. The shaft 116 at its aft end is splined to the forward end 220 of a brake shaft 222 whose aft end 224 is journaled by a bearing 226 to the aft end of the housing 98. A cone shaped annulus 228 is formed on the shaft 222. A hollow cylinder 230 is journaled on the forward end 220 of the brake shaft by bearings 232, and captured between the annulus 228 and a washer 234, which is secured to the shaft by a shaft shoulder and a lock ring 236. The aft end 238 of the cylinder 230 is formed as a bell mouth having a cone shaped inner wall which is lined with a pad of brake material 240. The cylinder 230 is also shiftable longitudinally on the forward end 220 of the brake shaft. When the cylinder 230 is forward, abuting the washer 234, the brake pad 240 clears the annulus 228. The cylinder 230 also includes a helical cam slot 242 which receives the cam roller 210. In the battery, or 360° gun cycle position, the roller 242 is in the aft end of the cam slot 242, proximate to the bell mouth. In the full counterrecoil, or 180° gun cycle position, the roller is in the forward end of the cam slot 242, remote from the bell mouth.

In operation, during recoil, the housing 98, together with the brake shaft 222, and the housing 72, together with the sleeves 68, inter alia, move aft relative to the gun mount 40 and the fixed thereto torsion shafts 50, thereby spacing the annulus 228 from the brake pad 240, and torquing the shafts 50. The slide 200 remains relatively stationary, as its feet 206 are captured by the clevises 80 which are fixed to the torsion shafts 50. The cylinder 230 is abuted by the washer 234 and carried aft by the brake shaft 228. As the cylinder goes aft it is carried into rotation about the brake shaft by the roller 210 on the stationary slide 200 riding in the cam track 242, until the roller is in the forward end of the track. During counterrecoil, the torsion shafts unwind, moving the housing 98 forward, and wedging the annulus 228 into the brake pad 240 to lock the brake shaft to the cylinder 230, and moving the cylinder forwardly relative to the staionary slide 200 and its roller 210. The aft face of the cam track 242 rides against the roller 210 and thereby the cylinder 230 is caused to rotate, together with the brake shaft 228 and the splined thereto shaft 116. The shaft 116 is coupled to the aft rotor and to the feeder. It may be noted that the cylinder 230 is self-timing in its power coupling function as distinquished from the yoke 94.

What is claimed is:

1. A gun comprising:

a stationary gun mount;

a gun housing journaled for reciprocation relative to said gun mount;

an operating mechanism carried by said housing;

an energy absorbtion and return mechanism coupled to said gun mount, said gun housing and said operating mechanism for absorbing and storing energy from the recoil movement of said housing relative to said gun mount, and for transmitting energy to said operating mechanism subsequent to said recoil movement;

a gun bolt coupled to said operating mechanism;

a gun barrel coupled to said operating mechanism;

said gun having a gun cycle from 0° to 360°;

said housing recoiling from 0° to 180°, and counter-recoiling from 180° to 360° of said gun cycle;

said gun barrel recoiling from 0° to 90°, and counter-recoiling from 90° to 180° of said gun cycle; and said energy absorbtion and return mechanism absorbing energy from 0° to 180°, and transmitting energy to said operating mechanism from 180° to 360° of said gun cycle.

2. A gun comprising:

a stationary gun mount;

a gun housing journaled for reciprocation relative to said gun mount;

an operating mechanism carried by said housing;

an energy absorbtion and return mechamism coupled to said gun mount, said gun housing and said operating mechanism for absorbing and storing energy from the recoil movement of said housing relative to said gun mount, and for transmitting energy to said operating mechanism subsequent to said recoil movement;

said energy absorbtion and return mechanism including spring means coupled by a first coupling means to said gun mount and by a second coupling means which is spaced from said first coupling means to said housing, so that recoil of said housing causes a progressive increase in the mutual spacing of said first and second coupling means and thereby a progressive transfer to and absorbiton by said spring means of energy from the recoiling housing.

3. A gun according to claim 2 wherein:

said spring means comprises a torsion shaft having a longitudinal axis.

4. A gun according to claim 3 wherein:

said first coupling means includes a rack adjustably secured to said gun mount, a gear mashed with said rack and fixed to said torsion shaft, whereby said rack can be adjusted to vary the angular orientation of said gear about said torsion shaft longitudinal axis.

5. A gun according to claim 3 wherein:

said second coupling means includes a cam driving means and a cam following means, said cam driving means being fixed to one member of the group consisting of said torsion shaft and said gun housng, said cam following means being fixed to the other member of said group, so constructed and arranged that longitudinal displacement of said cam driving means relative to said cam following means causes rotation of said torsion shaft about said torsion shaft longitudinal axis.

6. A gun according to claim 5 wherein:

said cam following means in a helical cam track fixed to said torsion shaft, and said cam driving means is a projection fixed to said housing and extending into said track.

7. A gun according to claim 2 wherein:

said energy absorbtion and return mechanism further includes clutch means coupled to and between said spring means and said operating mechanism, said clutch means being automatically decoupled while said mutual spacing of said first and second coupling means is increasing and coupled while said mutual spacing of said first and second coupling means is increasing.

8. A gun according to claim 2 wherein:

said spring means comprises a torsion shaft having a longitudinal axis; and said energy absorbtion and return mechanism further includes clutch means coupled to and between said torsion shaft and said operating mechanism, said clutch means being automatically decoupled while said mutual spacing of said first and second coupling means is increasing and coupled while said mutual spacing of said first and second coupling means is decreasing

9. A gun according to claim 8 wherein:

said clutch means comprises a lever having a head portion, a medial portion and a foot portion, said foot portion having a pivot which is longitudinally fixed relative to said gun mount, said medial portion having a pivot which is longitudinally fixed relative to said housing, and said head portion having a cam driver;

a cam follower fixed to said operating mechanism, so constructed and arranged that when said mutual spacing of said first and second coupling means is increasing, said cam driver is not engaged with said cam follower; and when said mutual spacing is decreasing, said cam driver drives said cam follower.

10. A gun according to claim 9 wherein:

said cam follower is a face cam journaled for rotation about a longitudinal axis.

11. A gun according to claim 8 wherein:

said operating means includes a rotatable means; and said clutch means includes a slide journaled to said housing for reciprocation relative thereto, and fixed relative to said gun mount, said slide having a cam driver, a third coupling means fixed to said rotatable means, a fourth coupling means having a cam folower, so constructed and arranged that when said mutual spacing of said first and second coupling means is increasing said third and fourth coupling means are mutually decoupled; and when said mutual spacing is decreasing, said third and fourth coupling means are mutually coupled and said cam driver drives said cam follower which rotates said fourth coupling means, to rotate said third coupling means, to rotate said rotating means of said operating means.

* * * * *

UNITED STATES PATENT OFFICE

CERTIFICATE OF CORRECTION

Patent No. 4,072,082 Dated February 7, 1978

Inventor(s) L. R. Folsom et al.

It is certified that error appears in the above-identified patent and that said Letters Patent are hereby corrected as shown below:

Column 1, line 44, after "supports" delete "to".

Column 4, line 6, "corss-" should read -- cross --.

Column 5, line 44, "mashed" should read -- meshed --.

Column 5,line 55, "housng" should read -- housing --.

Signed and Sealed this

Seventh Day of November 1978

[SEAL]

Attest:

RUTH C. MASON
Attesting Officer

DONALD W. BANNER
Commissioner of Patents and Trademarks